US012297721B2

(12) United States Patent
Benker

(10) Patent No.: US 12,297,721 B2
(45) Date of Patent: May 13, 2025

(54) REUSABLE PERFORATION GUN COUPLER SYSTEM

(71) Applicant: Axis Wireline Technologies, LLC, Canonsburg, PA (US)

(72) Inventor: David Council Benker, Cedar Park, TX (US)

(73) Assignee: Axis Wireline Technologies, LLC, Canonsburg, PA (US)

( * ) Notice: Subject to any disclaimer, the term of this patent is extended or adjusted under 35 U.S.C. 154(b) by 148 days.

(21) Appl. No.: 18/068,879

(22) Filed: Dec. 20, 2022

(65) Prior Publication Data

US 2023/0203922 A1 Jun. 29, 2023

Related U.S. Application Data

(60) Provisional application No. 63/308,095, filed on Feb. 9, 2022, provisional application No. 63/293,212, filed on Dec. 23, 2021.

(51) Int. Cl.

| | |
|---|---|
| ***E21B 43/119*** | (2006.01) |
| ***E21B 43/116*** | (2006.01) |
| *E21B 43/1185* | (2006.01) |

(52) U.S. Cl.

CPC ..... *E21B 43/119* (2013.01); *E21B 43/116* (2013.01); *E21B 43/1185* (2013.01)

(58) Field of Classification Search

CPC .... E21B 43/116; E21B 43/119; E21B 43/117; E21B 43/1185; F42D 1/055; F42D 1/05; F42D 1/02; F42B 3/02; F42B 3/10

See application file for complete search history.

(56) References Cited

U.S. PATENT DOCUMENTS

| | | | |
|---|---|---|---|
| 2,759,417 | A | 8/1956 | O'Neill, Jr. |
| 2,833,213 | A | 5/1958 | Udry |

(Continued)

FOREIGN PATENT DOCUMENTS

| | | | |
|---|---|---|---|
| CA | 1048925 | A | 2/1979 |
| CA | 3090586 | A1 | 2/2021 |

(Continued)

OTHER PUBLICATIONS

"Multi-material injection molding," retrieved from https://en.wikipedia.org/w/index.php?title=Multi-material_injection_molding&oldid=994490766, last edited Dec. 16, 2020, 3 pages.

(Continued)

*Primary Examiner* — Yong-Suk (Philip) Ro

(74) *Attorney, Agent, or Firm* — Trop, Pruner & Hu, P.C.

(57) ABSTRACT

A coupler system comprising: a coupler; first, second, and third bulkheads included in the coupler; an electrical switch included in the coupler, wherein the electrical switch includes a printed circuit board (PCB); wherein the first, second, and third bulkheads respectively include first, second, and third bulkhead electric contacts, and the first, second, and third bulkhead electric contacts include no resilient members; wherein: (a) the first bulkhead is to couple to a first proximal electrical contact of a proximal connector of a perforation gun, (b) the second bulkhead is to couple to a second proximal electrical contact of the proximal connector of the perforation gun, and (c) the third bulkhead is to couple to a distal electrical contact of a distal connector of another perforation gun. The coupler includes proximal and distal sacrificial blast plates.

16 Claims, 6 Drawing Sheets

(56) References Cited

U.S. PATENT DOCUMENTS

| | | | | |
|---|---|---|---|---|
| 4,007,796 | A | 2/1977 | Boop | |
| 4,208,966 | A | 6/1980 | Hart | |
| 4,441,427 | A | 4/1984 | Barrett | |
| 4,693,317 | A | 9/1987 | Edwards et al. | |
| 4,777,878 | A | 10/1988 | Johnson et al. | |
| 4,790,385 | A | 12/1988 | McClure et al. | |
| 4,869,170 | A | 9/1989 | Dahmberg et al. | |
| 5,088,413 | A | 2/1992 | Huber et al. | |
| 5,347,929 | A | 9/1994 | Lerche et al. | |
| 5,435,250 | A | 7/1995 | Pollock | |
| 5,823,266 | A | 10/1998 | Burleson et al. | |
| 6,658,981 | B2 | 12/2003 | Rochen et al. | |
| 6,837,310 | B2 | 1/2005 | Martin | |
| 7,762,331 | B2 | 7/2010 | Goodman et al. | |
| 7,762,351 | B2 | 7/2010 | Vidal | |
| 8,091,477 | B2 | 1/2012 | Brooks et al. | |
| 8,256,337 | B2 | 9/2012 | Hill et al. | |
| 8,661,978 | B2 | 3/2014 | Backhus et al. | |
| 8,746,144 | B2 | 6/2014 | Givens et al. | |
| 8,770,301 | B2 | 7/2014 | Bell | |
| 8,820,402 | B2 | 9/2014 | Smith et al. | |
| 8,875,787 | B2 | 11/2014 | Tassaroli | |
| 8,881,816 | B2 | 11/2014 | Glenn et al. | |
| 9,145,764 | B2 | 9/2015 | Burton et al. | |
| 9,194,219 | B1 | 11/2015 | Hardesty et al. | |
| 9,291,040 | B1 | 3/2016 | Hardesty et al. | |
| 9,518,454 | B2 | 12/2016 | Current et al. | |
| 9,523,271 | B2 | 12/2016 | Bonavides et al. | |
| 9,605,937 | B2 | 3/2017 | Eitschberger et al. | |
| 9,689,223 | B2 | 6/2017 | Schacherer et al. | |
| 10,077,641 | B2 | 9/2018 | Rogman et al. | |
| 10,174,595 | B2 | 1/2019 | Knight et al. | |
| 10,352,136 | B2 | 7/2019 | Goyeneche | |
| 10,422,195 | B2 | 9/2019 | LaGrange et al. | |
| 10,900,335 | B2 | 1/2021 | Knight et al. | |
| 10,914,145 | B2 | 2/2021 | Sullivan et al. | |
| 10,920,544 | B2 | 2/2021 | Sullivan et al. | |
| 11,053,783 | B2 | 7/2021 | Ashton et al. | |
| 11,054,233 | B2 | 7/2021 | Henke et al. | |
| 11,091,987 | B1 * | 8/2021 | Benker | E21B 43/119 |
| 11,098,563 | B1 | 8/2021 | Ludwig | |
| 11,208,873 | B2 | 12/2021 | Sullivan | |
| 11,236,591 | B2 | 2/2022 | Knight et al. | |
| 11,248,452 | B2 | 2/2022 | Sullivan et al. | |
| 11,255,162 | B2 | 2/2022 | Sullivan et al. | |
| 11,255,650 | B2 | 2/2022 | Sullivan et al. | |
| D947,253 | S | 3/2022 | Sullivan et al. | |
| 11,293,737 | B2 | 4/2022 | Sullivan et al. | |
| 11,859,957 | B2 * | 1/2024 | Kash | E21B 43/119 |
| 2012/0250208 | A1 | 10/2012 | Love et al. | |
| 2016/0356132 | A1 | 12/2016 | Burmeister et al. | |
| 2017/0275976 | A1 | 9/2017 | Collins et al. | |
| 2018/0299239 | A1 | 10/2018 | Fitschberger et al. | |
| 2019/0153827 | A1 | 5/2019 | Goyeneche | |
| 2019/0234188 | A1 | 8/2019 | Goyeneche | |
| 2019/0257181 | A1 | 8/2019 | Langford et al. | |
| 2020/0030593 | A1 | 1/2020 | Bourne et al. | |
| 2020/0224518 | A1 | 7/2020 | Trefilov | |
| 2020/0256166 | A1 | 8/2020 | Knight et al. | |
| 2020/0256168 | A1 * | 8/2020 | Knight | E21B 43/119 |
| 2020/0300593 | A1 | 9/2020 | Sullivan et al. | |
| 2020/0308939 | A1 | 10/2020 | Sullivan et al. | |
| 2021/0055092 | A1 | 2/2021 | Sullivan et al. | |
| 2021/0087909 | A1 | 3/2021 | Sullivan et al. | |
| 2021/0156231 | A1 | 5/2021 | Sullivan et al. | |
| 2021/0172298 | A1 * | 6/2021 | Knight | E21B 43/116 |
| 2021/0207934 | A1 | 7/2021 | Sullivan | |
| 2021/0223007 | A1 * | 7/2021 | Kash | E21B 43/1185 |
| 2021/0283751 | A1 | 9/2021 | Sullivan | |
| 2021/0332678 | A1 | 10/2021 | Anthony et al. | |
| 2021/0355797 | A1 | 11/2021 | Roberts et al. | |
| 2021/0372240 | A1 | 12/2021 | Benker et al. | |
| 2022/0056789 | A1 | 2/2022 | LaGrange et al. | |
| 2022/0099423 | A1 * | 3/2022 | Sullivan | F42B 3/10 |
| 2022/0120547 | A1 | 4/2022 | Sullivan | |
| 2022/0120548 | A1 * | 4/2022 | Sullivan | E21B 43/1185 |
| 2023/0069950 | A1 * | 3/2023 | Badii | E21B 43/1185 |

FOREIGN PATENT DOCUMENTS

| | | | |
|---|---|---|---|
| CN | 208280948 | U | 12/2018 |
| CN | 109690019 | B | 8/2020 |
| EP | 0874130 | B1 | 1/2006 |
| WO | 2020112308 | A1 | 6/2020 |

OTHER PUBLICATIONS

"Tandem Sub", retrieved from https://www.yjoiltools.com/Wireline-Subs/Tandem-Sub, 3 pages.

Zhao et al., "Sliding sleeve packer multistage completion in Re-exploration Programs for Petroleum-Rich Sags in Rift Basins, Advances in Key Engineering Technologies for Re-exploration 2018," https://www.sciencedirect.com/topics/engineering/completion-process.

Snyder, "Is the Shale Revolution Here to Stay," OilPrice.com—blog; https://community.oilprice.com/topic/6261-is-the-shale-revolution-here-to-stay/, May 15, 2019, 63 pages.

Zhang et al., "Finite element modeling of the shaped charge jet and design of the reusableperforating gun", Petroleum Science (2020) 17:1389-1399, Dec. 20, 2019.

Fimreite et al., "Sealed Connector System Eliminates Explosive Hazards and Saves Time in the Makeup Operation for Tubing-Conveyed Perforating-Gun Systems" (abstract); Paper presented at the SPE Western Regional Meeting, Irvine, California, Mar. 2005.

"HEGS High-efficiency gun systems" downloaded Dec. 20, 2022 from https://www.slb.com/completions/well-completions/perforating/perforating-gun-systems/hollow-carrier/hegs-high-efficiency-gun-system.

"Wireline Selective Firing Systems" downloaded Dec. 20, 2022 from http://www.hunting-intl.com/titan/wireline-selective-firing-systems.

"Expendable Perforating Guns MAN-ERHSC", Core Lab Reservoir Optimization, Owen Oil Tools, Revised Jul. 2008, Rev. 4.

* cited by examiner

REUSABLE PERFORATION GUN COUPLER SYSTEM

CROSS-REFERENCE TO RELATED APPLICATION

This application claims priority to U.S. Provisional Patent Application No. 63/293,212 filed on Dec. 23, 2021 and entitled "Reusable Perforation Gun Coupler System". This application further claims priority to U.S. Provisional Patent Application No. 63/308,095 filed on Feb. 9, 2022 and entitled "Reusable Perforation Gun Coupler System". The content of each of the above applications is hereby incorporated by reference.

TECHNICAL FIELD

Embodiments of the invention are in the field of oilfield equipment and, in particular, perforation guns.

BACKGROUND

In conventional methods a user may couple perforation guns together and then use explosives within the guns to fracture rock formations. Oil may then flow through the fractured rock formations. This may involve hydraulic "fracking", which involves injecting liquid at high pressure into subterranean rocks, boreholes, and the like to force open existing fissures and extract oil or gas. A typical perforation gun may include a long tube that includes charges. These guns may couple together with a coupler, which is sometimes called a "tandem sub" (https://***.yjoiltools.com/Wireline-Subs/Tandem-Sub). The coupler's external threads mate with internal threads of the gun.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

DETAILED DESCRIPTION

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photograph, may appear different while still incorporating the claimed structures of the illustrated embodiments. Moreover, the drawings may only show the structures useful to understand the illustrated embodiments. Additional structures known in the art may not have been included to maintain the clarity of the drawings. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A and B" include situations with A, B, or A and B.

An embodiment includes a reusable sub/puck with an internal switch and sacrificial blast plates for perforation gun systems. The reusable puck contains reusable bulkheads and a reusable switch. The blast plates protect the reusable puck/switch/bulkheads from the explosion temperature and concussion in order to be able to reuse the sub/puck. By protecting the puck with sacrificial blast plates, users are able to reuse the puck. The embodiment also allows the pucks to be cleaned more quickly versus current systems that, if reusable, require a great deal of time to clean and rework the subs/pucks. Also, embodiments save costs for the switch and bulkheads as opposed to older systems by allowing a user to reused those elements. Embodiments may allow a user to reuse the puck 100 times or more and the user may be able to amortize the cost of those parts across many guns (as opposed to having to dispose of switches after every use).

The following addresses several figures as well as parts displayed in those figures.

Figure 1A:
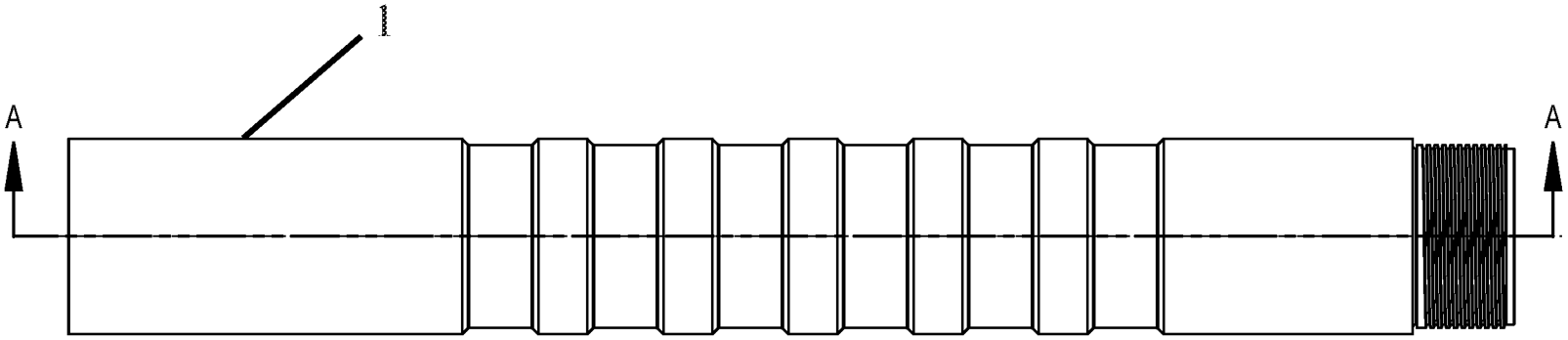
FIG. 1A includes a top view of the same.
Figure 1B:
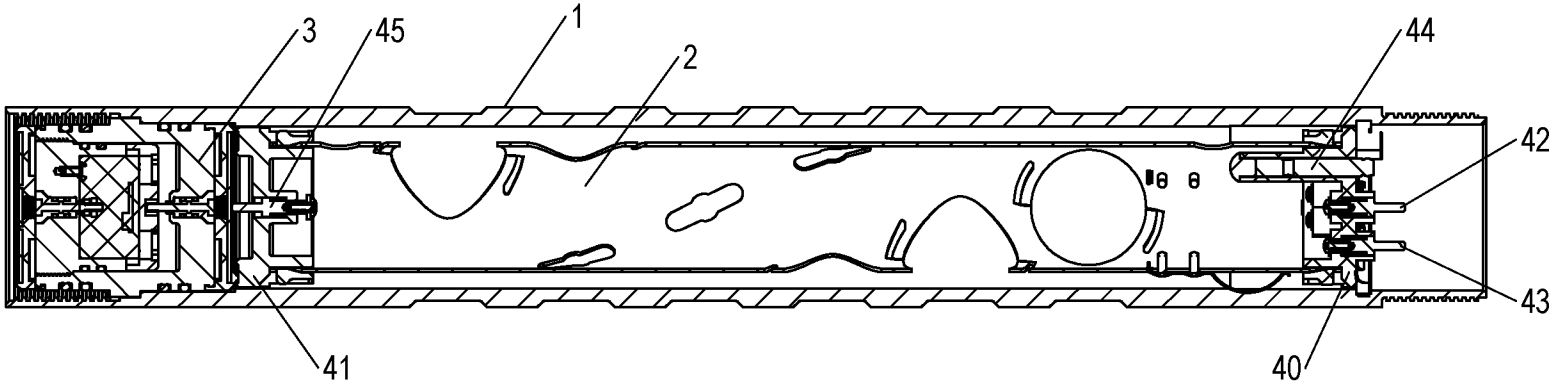
FIG. 1B includes a cross-sectional view of an embodiment of a single gun having inner and outer conduits, proximal and distal connectors (e.g., caps), and a coupler (also known as a sub assembly or "sub" or "puck").

FIGS. 1A and 1B disclose a gun assembly with a steel gun barrel 1, which has circumferential grooves for indexing shot orientation. The assembly includes an indexing charge barrel 2 (charges not shown) as well as reusable sub 3, which includes a charge switch and protective blast plates.

Figure 2:
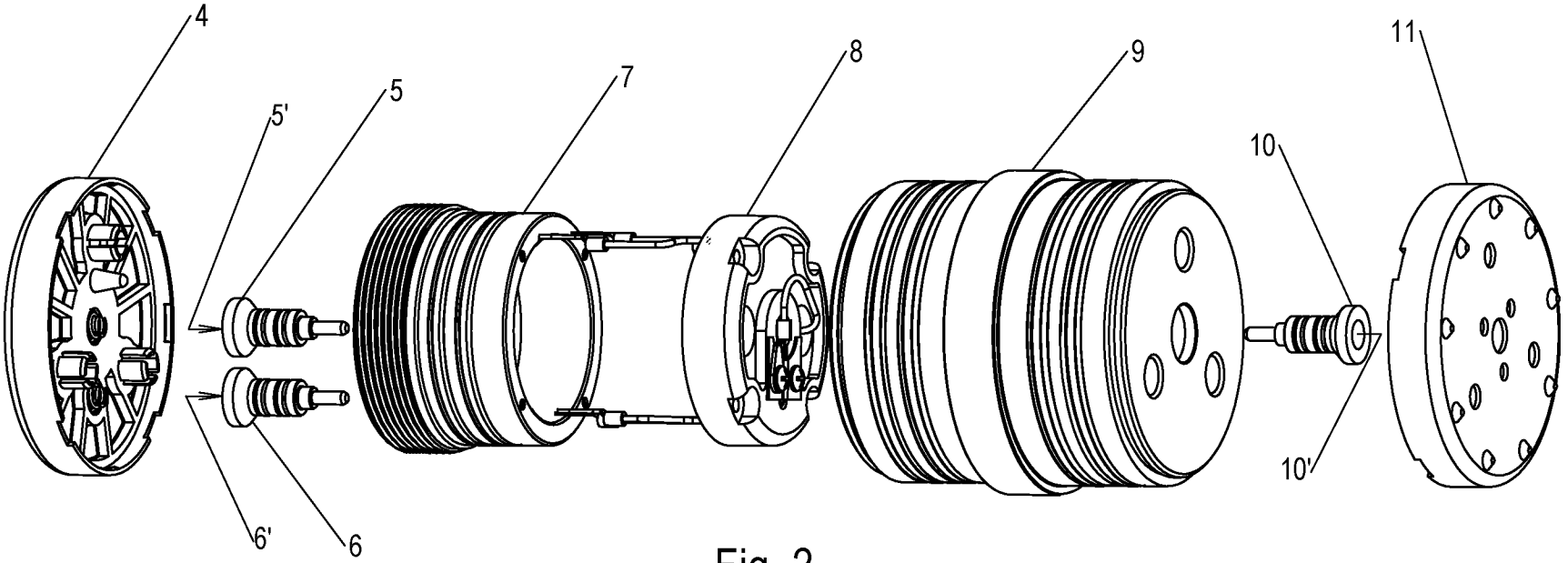
FIG. 2 includes an exploded view of an embodiment of a coupler having bulkheads.

FIG. 2 includes a reusable sub (a.k.a. coupler). The coupler includes expendable bottom blast plates 4 and 11 and an output firing signal blast barrier with a conductive core and insulated sleeve 5 and an output pass through signal blast barrier with conductive core and insulated sleeve 6. The sub includes a corrosion resistant steel lower sub body 7 filled with insulating potting compound after assembly and switch block 8. Non-conductive switch block 8 includes a firing switch. The sub includes corrosion resistant steel upper sub housing 9 as well as input signal blast barrier with conductive core and insulated sleeve 10.

Figure 3A:
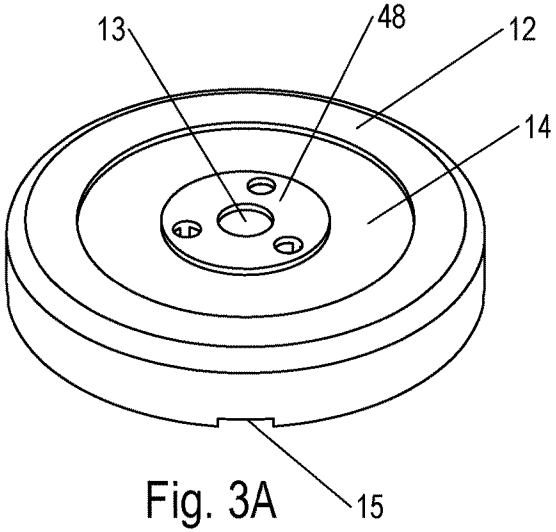
FIG. 3A includes a top view of an embodiment of a protective distal plate and FIG. 3B includes a bottom view of the same.
Figure 3B:
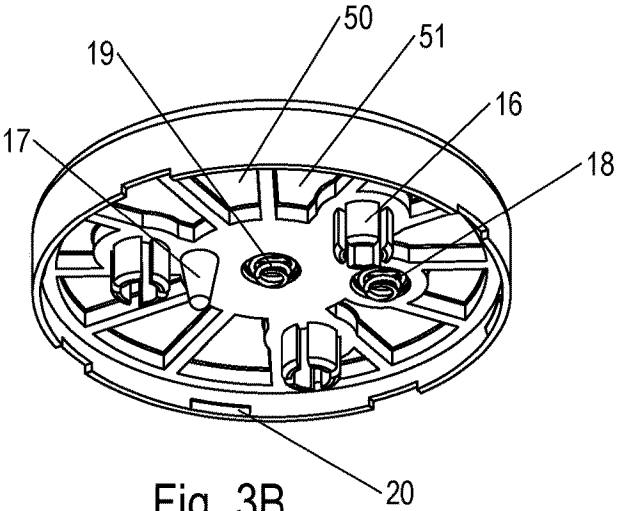

FIG. 3A includes an expendable bottom/distal blast plate with nonconductive body 12 of the bottom blast plate, corrosion resistant steel output firing signal contact plate 13, corrosion resistant steel pass through contact plate 14, and slot 15 to facilitate removal of expendable bottom blast plate assembly. FIG. 3B depicts another view of the expendable bottom blast plate. Features 16 are used for concentric positioning of the blast plate at assembly. The plate further includes a feature 17 for angular alignment of blast plate at assembly as well as firing signal corrosion resistant steel spring 19 between the contact plate and the blast barrier, and pass-through signal corrosion resistant steel spring contact 18 between contact plate and blast barrier. Element 20 is a blast plate assembly retaining feature.

Figure 4A:
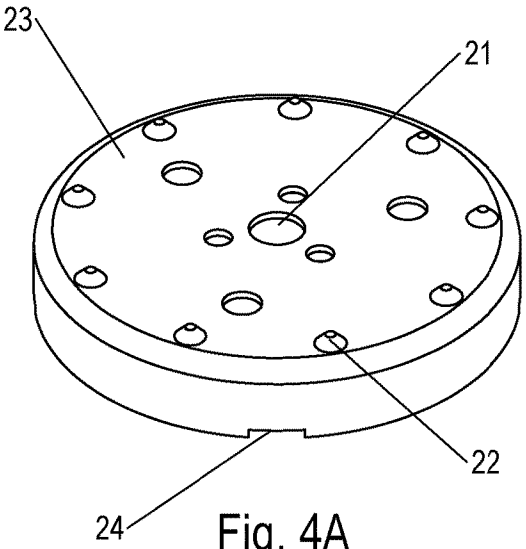
FIG. 4A includes a top view of an embodiment of a protective proximal plate and FIG. 4B includes a bottom view of the same.
Figure 4B:
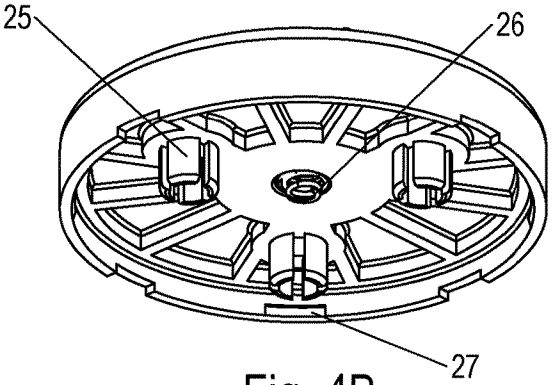

FIG. 4A includes an expendable top blast plate. The plate includes a corrosion resistant steel input signal contact plate 21, indexing features 22 for positioning the charge loading tube relative to the outer barrel, nonconductive body 23 of the top blast plate, and slot 24 to facilitate removal of expendable top blast plate assembly. FIG. 4B includes another view of the expendable top blast plate. Features 25 are for concentric positioning of the blast plate at assembly. Input signal corrosion resistant steel spring 26 is between the contact plate and blast barrier. The plate further includes blast plate assembly retaining features 27.

Figure 5B:
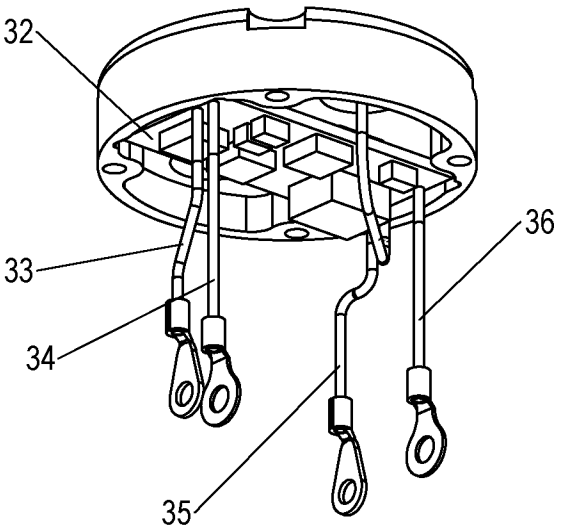
FIG. 5A includes a top view of an embodiment of a switch module and FIG. 5B includes a bottom view of the same.
Figure 5A:
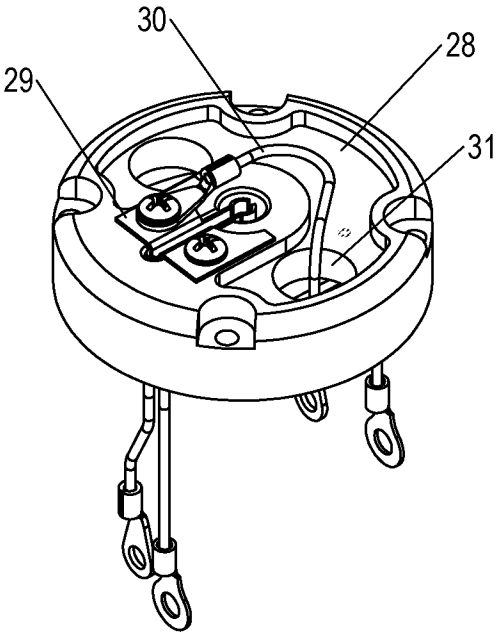
Figure 6B:
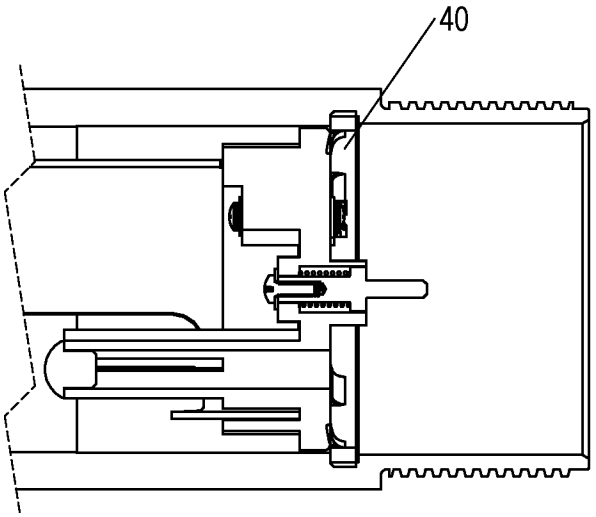
FIG. 6B includes a cross-sectional view of a proximal connector.
Figure 6A:
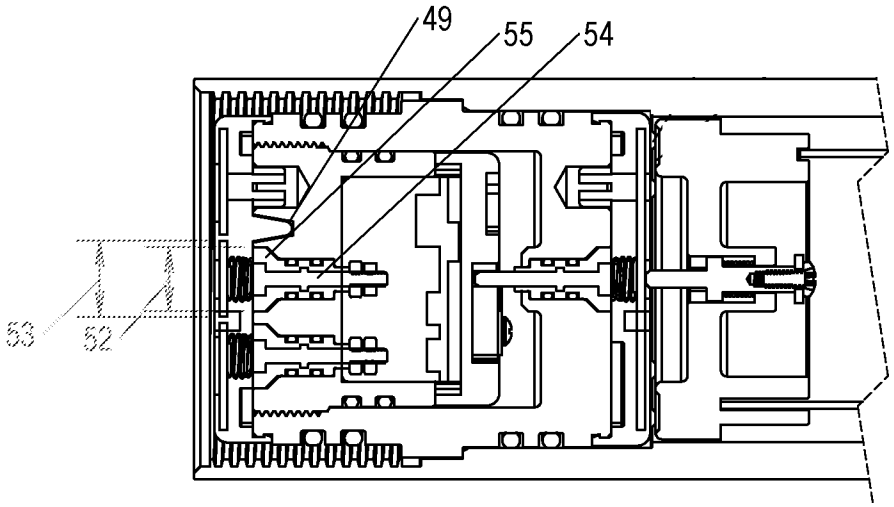
FIG. 6A includes a cross-sectional view of a coupler and distal connector.
Figure 7:
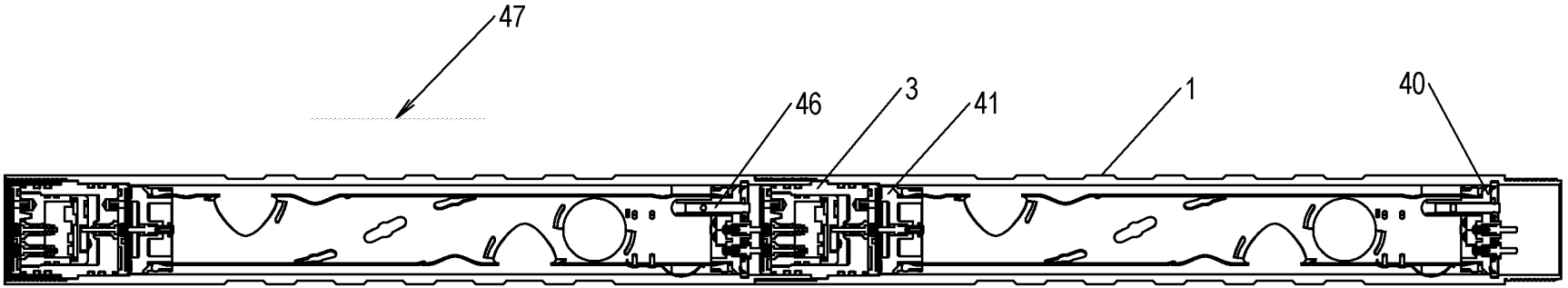
FIG. 7 includes an assembly of a coupler coupling two perforation guns to one another.

FIG. 5A includes a switch module. The module includes nonconductive switch module body 28, rotational input signal contact spring 29, signal input wire 30, and opening 31 for potting after assembly to sub lower body. FIG. 5B includes another view of the switch module with firing switch 32, detonator firing wire 33, ground wire 34, ground wire 35, and pass-through signal wire 36.

Various examples of embodiments are now addressed.

Example 1. A hydraulic fracturing system comprising a perforation gun that includes a first outer conduit (1), a first inner conduit (2) included in the first outer conduit, a first proximal connector (40), and a first distal connector (41). Coupler (3) is included in the perforation gun. First (5), second (6) and third (10) bulkheads are included in the coupler. An electrical switch (32) is included in the coupler and the electrical switch includes a printed circuit board (PCB). The proximal connector includes: (a) a first proximal electrical contact (42) to couple to an additional first bulkhead of an additional coupler (not shown), (b) a second proximal electrical contact (43) to couple to an additional second bulkhead of the additional coupler; and (c) an aperture (44) to receive a detonator. The distal connector includes a distal electric contact (45) to couple to the third bulkhead. The coupler couples to the first outer conduit without use of threads. The first, second, and third bulkheads respectively include first (5'), second (6'), and third (10') bulkhead electric contacts. The first, second, and third bulkhead electric contacts include no resilient members. The first bulkhead is to couple to an additional first proximal electrical contact of an additional proximal connector (46) of an additional perforation gun (47). The second bulkhead is to couple to an additional second proximal electrical contact of the additional proximal connector of the additional perforation gun.

This embodiment differs from many conventional systems because, for example, the switch is included within the coupler or "puck" or "tandem sub". Other systems may include the switch in the inner tube of the gun, and as a result the switch is destroyed after detonation of charges in the gun.

Alternative version of Example 1. A hydraulic fracturing system comprising: a perforation gun that includes a first outer conduit (1), a first inner conduit (2) included in the first outer conduit, a first proximal connector (40), and a first distal connector (41); a coupler (3) included in the perforation gun; first (5), second (6) and third (10) bulkheads included in the coupler; an electrical switch (32) included in the coupler, wherein the electrical switch includes a printed circuit board (PCB); wherein the proximal connector includes: (a) a first proximal electrical contact (42) to couple to an additional first bulkhead of an additional coupler (not shown), (b) a second proximal electrical contact (43) to couple to an additional second bulkhead of the additional coupler; and (c) an aperture (44) to receive a detonator; wherein the distal connector includes a distal electric contact (45) to couple to the third bulkhead; wherein the first, second, and third bulkheads respectively include first, second, and third bulkhead electric contacts, and the first (5'), second (6'), and third (10') bulkhead electric contacts include no resilient members, wherein: (a) the first bulkhead is to couple to an additional first proximal electrical contact of an additional proximal connector (46) of an additional perforation gun (47), (b) the second bulkhead is to couple to an additional second proximal electrical contact of the additional perforation gun.

Thus, in some embodiments the coupler may couple to the gun via a threaded or non-threaded interface.

Example 2. The system of example 1, wherein: the coupler includes proximal (11) and distal (4) plates; the distal plate has first (13) and second (14) electrical contacts; the proximal plate has a third electrical contact (21); the first bulkhead couples the first electrical contact to the electrical switch; the second bulkhead couples the second electrical contact to the electric switch; and the third bulkhead couples the third electrical contact to the electric switch.

The proximal and distal plates may be "blast plates" of sufficient strength to protect the coupler from detonation-induced energy from perforations guns. Embodiments include just a distal plate, just a proximal plate, or both distal and proximal plates. The plate or plates may be made of a material (of sufficient hardness and/or compressive and/or tensile strength) and dimension (e.g., thickness) to withstand the energy blast and protect the switch and other components of the coupler. The plate or plates may be destroyed by the blast and serve as "sacrificial" components that are easily "snapped off" (or otherwise disconnected from) the coupler and replaced so the coupler can be reused.

Example 3. The system of example 2 comprising first (19), second (18), and third (26) resilient members, wherein: the first resilient member couples the first electrical contact to the first bulkhead and biases the first bulkhead towards the electrical switch; the second resilient member couples the second electrical contact to the second bulkhead and biases the second bulkhead towards the electrical switch; and the third resilient member couples the third electrical contact to the third bulkhead and biases the third bulkhead towards the electrical switch.

In other embodiments, the resilient members (e.g., springs) may be omitted such that contact 13 directly contacts a pin or corresponding bulkhead/insulated coupler.

Example 4. The system according to any of examples 2-3, wherein the second electrical contact encircles the first electrical contact.

This helps create a "non-indexed" portion such that plate 14 can interface the downstream/distal connector and contact (analogous to contact 43) without requiring a specific alignment between the two perforation guns.

Example 5. The system of example 4 comprising a circular insulator ring (48) between the first and second electrical contacts to prevent electrical shorting between the first and second electrical contacts.

Ring 48 may electrically isolate contact 13 from contact 14. However, in other embodiments other insulators may be used to hold the contacts in place and/or ensure no electrical shorting occurs between contacts 13, 14.

Example 6. The system according to any of examples 2-5, wherein the distal plate includes metal and the proximal plate includes metal.

For example, steel is a viable choice to provide adequate protection to the sensitive switch and other components of the coupler between the plates.

Example 7. The system according to any of examples 2-6, wherein the distal plate is keyed to align the second electrical contact to the second bulkhead.

Example 8. The system according to example 7, wherein: the coupler includes a body (7) to couple the proximal and distal plates to each other; the first and second bulkheads couple to the body; the distal plate includes one of a male or female key component (17); the body includes another of the male or female key component (49) to align the second electrical contact to the second bulkhead when the distal plate is coupled to the body.

Example 9. The system according to any of examples 2-7, wherein the proximal and distal plates are removably coupled to the coupler.

For example, plates may couple to the coupler via components 16, 25. Portions 15, 24 allow one to slide a flathead screwdriver into a void to "pop off" the plates from the coupler.

Example 10. The system of example 9 wherein: the proximal plate is not screwed to the coupler; the proximal plate is not adhered to the couple with an adhesive; the distal plate is not screwed to the coupler; the distal plate is not adhered to the couple with an adhesive;

This promotes ease of use in quickly refurbishing a coupler for another firing by simply exchanging damaged plates for undamaged plates.

Example 11. The system according to any of examples 2-10 wherein: the distal plate includes voids (50, 51); the coupler includes a long axis that intersects the proximal and distal plates; a plane, which is orthogonal to the long axis, intersects the voids.

The voids function as "crumple zones" to absorb blast energy and protect the coupler. Resilient members 18, 19, 26 also help absorb blast energy.

Example 12. The system according to any of examples 2-10 wherein: the coupler includes a long axis that intersects the proximal and distal plates; the first electrical contact has a maximum breadth (53) measured orthogonal to the long axis; the first bulkhead has distal-most end and the distal-most end has a maximum breadth (52) measured orthogonal to the long axis; the maximum breath of the first contact is greater than the maximum breadth of the distal-most end of the first bulkhead.

As a result, when contact 13 is blasted towards pin 54 the wider contact (or at least a portion thereof) contacts body 7 instead of driving its full energy into pin 54 (which could harm the pin).

Example 13. The system according to example 12 wherein the first bulkhead tapers and narrows proximally such that a proximal end of the first bulkhead has a smaller maximum breadth, measured orthogonal to the long axis, than the maximum breadth of the distal-most end of the first bulkhead.

In an embodiment this may help diffuse the energy across a greater surface area at the location (distal) closest to the downstream blast energy.

Example 14. The system of example 1, wherein: the coupler includes a distal plate; the distal plate has first and second electrical contacts; the first bulkhead couples the first electrical contact to the electrical switch; and the second bulkhead couples the second electrical contact to the electric switch.

Not all embodiments necessarily include a proximal plate.

Example 15. The system of example 1, wherein: the coupler includes a proximal plate; the proximal plate has an electrical contact; the third bulkhead couples the electrical contact to the electric switch.

Not all embodiment necessarily include a distal plate.

Example 16. The system according to any of examples 1-15, wherein the electrical switch is between the first and third bulkheads.

Example 17. The system according to any of examples 1-16, wherein: the first bulkhead includes a monolithic metal conductor (54) that extends from a proximal most end of the first bulkhead to a distal-most end of the first bulkhead electric contact; the monolithic metal conductor includes no welds, seems, or resilient members.

In an embodiment, the lack of resilient members does not necessarily preclude items such as O-rings but does exclude coils or springs. In an embodiment the first bulkhead comprises an overmold, wherein: the overmold includes a non-metal material; the first bulkhead includes the overmold; and the overmold directly contacts first and second portions (which have different outer diameters or maximum breadths) of the bulkhead electric contact.

In an embodiment the first bulkhead comprises a mold, wherein: the mold includes a non-metal material; the bulkhead electric contact includes metal; the bulkhead includes the mold; and the mold directly contacts and is form-fitted to first and second portions (which have different outer diameters or maximum breadths) of the bulkhead electric contact.

As used herein, over molding includes the use of layering effects in polymer application techniques. This process is centered around the use of a liquidous resin to add additional layers of shape and structure to an existing component. An example of such a resin could be a polymer that has been heated to a temperature just above its glass transition temperature. The existing component to which the resin is being added is often injection molded as well (but that is not necessarily the case for embodiments used herein), and may be near its own glass transition temperature.

Another embodiment may utilize insert molding, which is a similar process to overmolding but instead uses a pre-formed part, often metal, that is loaded into a mold where it is then overmolded with a thermoplastic resin to create a final component. When the run is complete, parts are boxed and shipped shortly thereafter.

Regardless of overmolding or insert molding, embodiments include a material that is molded to the bulkhead electric contact. The molded material may include polyether ether ketone (PEEK) and gaskets (e.g., O-rings) may reside within voids formed, at least partially, in the overmold.

Example 18. The system according to example 17 comprising a mold (55), wherein: the mold includes a non-metal material; the mold directly contacts and is form-fitted to monolithic metal conductor.

Example 19. The system according to any of examples 1-18 wherein: the coupler includes a long axis that intersects the proximal and distal plates; the long axis intersects the first and third bulkheads but not the second bulkhead.

Example 20. The system of example 19 wherein a plane, which is orthogonal to the long axis, intersects the first and second bulkheads but not the third bulkheads.

Example 21. The system according to any of example 1-20, wherein the coupler is configured to couple the perforation gun to the additional perforation gun and to reduce a transmission of explosive induced pressure between the perforation gun and the additional perforation gun.

Example 22. The system according to any of examples 1-21, wherein: the coupler includes a body (7) to couple the proximal and distal plates to each other; the body includes a void; and the void includes a non-conductive potting compound that contacts the PCB.

The potting may help ensure wiring and terminal/cable interfaces are supported and protected during blast-induced concussions. Potting may be transferred into the void via aperture 31.

An embodiment includes only the coupler of any of examples 1-22. In other words, the coupler may be sold or shipped separately from the perforation gun. Thus, the coupler may be included in a package or shipping container that does not include the inner/outer conduits, proximal/distal caps/connectors, and the like. For example, here is an alternative version of example 1.

Alternative version of Example 1. A coupler system comprising: a coupler (3); first (5), second (6), and third (10) bulkheads included in the coupler; an electrical switch (32) included in the coupler, wherein the electrical switch includes a printed circuit board (PCB); wherein the first, second, and third bulkheads respectively include first (5'), second (6'), and third (10') bulkhead electric contacts, and the first, second, and third bulkhead electric contacts include no resilient members; wherein: (a) the first bulkhead is to couple to a first proximal electrical contact of a proximal connector of a perforation gun, (b) the second bulkhead is to couple to a second proximal electrical contact of the proximal connector of the perforation gun, and (c) the third bulkhead is to couple to a distal electrical contact of a distal connector of another perforation gun.

Example 1a. A hydraulic fracturing system comprising: a perforation gun that includes a first outer conduit (1), a first inner conduit (2) included in the first outer conduit, a first proximal connector (40), and a first distal connector (41); a tandem sub (3) included in the perforation gun; first (5), second (6) and third (10) insulated conductors included in the tandem sub; an electrical switch (32) included in the tandem sub, wherein the electrical switch includes a printed circuit board (PCB); wherein the proximal connector includes: (a) a first proximal electrical contact (42) to couple to an additional first insulated conductor of an additional tandem sub (not shown), (b) a second proximal electrical contact (43) to couple to an additional second insulated conductor of the additional tandem sub; and (c) an aperture (44) to receive a detonator; wherein the distal connector includes a distal electric contact (45) to couple to the third insulated conductor; wherein (a) the tandem sub couples to the first outer conduit without use of threads, and (b) the first, second, and third insulated conductors respectively include first, second, and third insulated conductor electric contacts, and the first (5'), second (6'), and third (10') insulated conductor electric contacts include no resilient members, wherein: (a) the first insulated conductor is to couple to an additional first proximal electrical contact of an additional proximal connector (46) of an additional perforation gun (47), (b) the second insulated conductor is to couple to an additional second proximal electrical contact of the additional proximal connector of the additional perforation gun.

This example set is similar to the first example set but includes "insulated conductor" instead of "bulkhead". This provides for mere conductors, such as a metal pin, that is insulated with, for example, a nonconductive molding (e.g., overmolding). Further, "tandem sub" is used instead of "coupler". However, other versions of this example set include any combination of "tandem sub", "coupler", "bulkhead", and/or "insulated conductor".

Example 2a. The system of example 1a, wherein: the tandem sub includes proximal (11) and distal (4) plates; the distal plate has first (13) and second (14) electrical contacts; the proximal plate has a third electrical contact (21); the first insulated conductor couples the first electrical contact to the electrical switch; the second insulated conductor couples the second electrical contact to the electric switch; the third insulated conductor couples the third electrical contact to the electric switch.

Example 3a. The system of example 2a comprising first (19), second (18), and third (26) resilient members, wherein: the first resilient member couples the first electrical contact to the first insulated conductor and biases the first insulated conductor towards the electrical switch; the second resilient member couples the second electrical contact to the second insulated conductor and biases the second insulated conductor towards the electrical switch; and the third resilient member couples the third electrical contact to the third insulated conductor and biases the third insulated conductor towards the electrical switch.

Example 4a. The system according to any of examples 2a-3a, wherein the second electrical contact encircles the first electrical contact.

Example 5a. The system of example 4a comprising a circular insulator ring (48) between the first and second electrical contacts to prevent electrical shorting between the first and second electrical contacts.

Example 6a. The system according to any of examples 2a-5a, wherein the distal plate includes metal and the proximal plate includes metal.

Example 7a. The system according to any of examples 2a-6a, wherein the distal plate is keyed to align the second electrical contact to the second insulated conductor.

Example 8a. The system according to example 7a, wherein: the tandem sub includes a body (7) to couple the proximal and distal plates to each other; the first and second insulated conductors couple to the body; the distal plate includes one of a male or female key component (17); the body includes another of the male or female key component (49) to align the second electrical contact to the second insulated conductor when the distal plate is coupled to the body.

Example 9a. The system according to any of examples 2a-7a, wherein the proximal and distal plates are removably coupled to the tandem sub.

Example 10a. The system of example 9a wherein: the proximal plate is not screwed to the tandem sub; the proximal plate is not adhered to the couple with an adhesive; the distal plate is not screwed to the tandem sub; the distal plate is not adhered to the couple with an adhesive.

Example 11a. The system according to any of examples 2a-10a wherein: the distal plate includes voids (50, 51); the tandem sub includes a long axis that intersects the proximal and distal plates; a plane, which is orthogonal to the long axis, intersects the voids.

Example 12a. The system according to any of examples 2a-10a wherein: the tandem sub includes a long axis that intersects the proximal and distal plates; the first electrical contact has a maximum breadth (53) measured orthogonal to the long axis; the first insulated conductor has distal-most end and the distal-most end has a maximum breadth (52) measured orthogonal to the long axis; the maximum breath of the first contact is greater than the maximum breadth of the distal-most end of the first insulated conductor.

Example 13a. The system according to example 12a wherein the first insulated conductor tapers and narrows proximally such that a proximal end of the first insulated conductor has a smaller maximum breadth, measured orthogonal to the long axis, than the maximum breadth of the distal-most end of the first insulated conductor.

Example 14a. The system of example 1a, wherein: the tandem sub includes a distal plate; the distal plate has first and second electrical contacts; the first insulated conductor couples the first electrical contact to the electrical switch; and the second insulated conductor couples the second electrical contact to the electric switch.

Example 15a. The system of example 1a, wherein: the tandem sub includes a proximal plate; the proximal plate has an electrical contact; the third insulated conductor couples the electrical contact to the electric switch.

Example 16a. The system according to any of examples 1a-15a, wherein the electrical switch is between the first and third insulated conductors.

Example 17a. The system according to any of examples 1a-16a, wherein: the first insulated conductor includes a monolithic metal conductor (54) that extends from a proximal most end of the first insulated conductor to a distal-most end of the first insulated conductor electric contact; the monolithic metal conductor includes no welds, seems, or resilient members.

Example 18a. The system according to example 17a comprising a mold (55), wherein: the mold includes a non-metal material; the mold directly contacts and is form-fitted to monolithic metal conductor.

Example 19a. The system according to any of examples 1a-18a wherein: the tandem sub includes a long axis that intersects the proximal and distal plates; the long axis intersects the first and third insulated conductors but not the second insulated conductor.

Example 20a. The system of example 19a wherein a plane, which is orthogonal to the long axis, intersects the first and second insulated conductors but not the third insulated conductors.

Example 21a. The system according to any of example 1a-20a, wherein the tandem sub is configured to couple the perforation gun to the additional perforation gun and to reduce a transmission of explosive induced pressure between the perforation gun and the additional perforation gun.

Example 22a. The system according to any of examples 1a-21a, wherein: the tandem sub includes a body (7) to couple the proximal and distal plates to each other; the body includes a void; and the void includes a non-conductive potting compound that contacts the PCB.

Example 23. A method comprising providing: a perforation gun that includes a first outer conduit (1), a first inner conduit (2) included in the first outer conduit, a first proximal connector (40), and a first distal connector (41); a tandem sub (3) included in the perforation gun; first (5), second (6) and third (10) insulated conductors included in the tandem sub; an electrical switch (32) included in the tandem sub, wherein the electrical switch includes a printed circuit board (PCB); wherein the proximal connector includes: (a) a first proximal electrical contact (42) coupled to an additional first insulated conductor of an additional tandem sub, (b) a second proximal electrical contact (43) coupled to an additional second insulated conductor of the additional tandem sub; and (c) an aperture (44) that includes a detonator; wherein the distal connector includes a distal electric contact (45) coupled to the third insulated conductor; wherein (a) the tandem sub is coupled to the first outer conduit without use of threads, and (b) the first, second, and third insulated conductors respectively include first, second, and third insulated conductor electric contacts, and the first (5'), second (6'), and third (10') insulated conductor electric contacts include no resilient members; wherein: (a) the first insulated conductor couples to an additional first proximal electrical contact of an additional proximal connector (46) of an additional perforation gun (47), (b) the second insulated conductor couples to an additional second proximal electrical contact of the additional proximal connector of the additional perforation gun; wherein: (a) the tandem sub includes proximal (11) and distal (4) plates; (b) the distal plate has first (13) and second (14) electrical contacts; (c) the proximal plate has a third electrical contact (21); (d) the first insulated conductor couples the first electrical contact to the electrical switch; (e) the second insulated conductor couples the second electrical contact to the electric switch; and (f) the third insulated conductor couples the third electrical contact to the electric switch;

The method further comprises inducing explosions in the perforation gun and the additional perforation gun via activation of the electrical switch.

In response to inducing explosions in the perforation gun and the additional perforation gun via activation of the electrical switch, the method comprises replacing the proximal and distal plates with additional proximal and distal plates.

In response to replacing the proximal and distal plates with additional proximal and distal plates, the method comprises inducing explosions in the perforation gun and the additional perforation gun via activation of the electrical switch.

Thus, the same switch is reused after the plates are exchanged.

Bulkheads (e.g., element 5 of FIG. 2) addressed herein provide advantages over conventional systems that conduct data signals through resilient members, such as springs. With vibrating environments common to oilfields, this conduction path can be less than reliable.

As used herein, monolithic means formed of a single piece of material. For example, the bulkhead electric contact may be formed via machining or removing material from a single piece of metal via a lathe process or the like.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A hydraulic fracturing system comprising:

a perforation gun that includes a first outer conduit, a first inner conduit included in the first outer conduit, a first proximal connector, and a first distal connector;

a coupler included in the perforation gun;

first, second, and third bulkheads included in the coupler; and an electrical switch included in the coupler, wherein the electrical switch includes a printed circuit board (PCB);

wherein the first proximal connector includes: (a) a first proximal electrical contact to couple to an additional first bulkhead of an additional coupler, (b) a second proximal electrical contact to couple to an additional second bulkhead of the additional coupler; and (c) an aperture to receive a detonator;

wherein the first distal connector includes a distal electric contact to couple to the third bulkhead;

wherein (a) the coupler couples to the first outer conduit without use of threads, and (b) the first, second, and third bulkheads respectively include first, second, and third bulkhead electric contacts, and the first, second, and third bulkhead electric contacts include no resilient members, wherein: (a) the first bulkhead is to couple to an additional first proximal electrical contact of an additional proximal connector of an additional perforation gun, (b) the second bulkhead is to couple to an additional second proximal electrical contact of the additional proximal connector of the additional perforation gun.

2. The system of claim 1, wherein:

the coupler includes proximal and distal plates;

the distal plate has first and second electrical contacts;

the proximal plate has a third electrical contact;

the first bulkhead couples the first electrical contact to the electrical switch;

the second bulkhead couples the second electrical contact to the electric switch; and the third bulkhead couples the third electrical contact to the electric switch.

3. The system of claim 2 comprising first, second, and third resilient members, wherein:

the first resilient member couples the first electrical contact to the first bulkhead and biases the first bulkhead towards the electrical switch;

the second resilient member couples the second electrical contact to the second bulkhead and biases the second bulkhead towards the electrical switch; and the third resilient member couples the third electrical contact to the third bulkhead and biases the third bulkhead towards the electrical switch.

4. The system of claim 3, wherein the second electrical contact encircles the first electrical contact.

5. The system of claim 4 comprising a circular insulator ring between the first and second electrical contacts to prevent electrical shorting between the first and second electrical contacts.

6. The system of claim 2, wherein:

the proximal and distal plates are removably coupled to the coupler;

the proximal plate is not screwed to the coupler;

the proximal plate is not adhered to the coupler with an adhesive;

the distal plate is not screwed to the coupler; and the distal plate is not adhered to the coupler with an adhesive.

7. The system of claim 2, wherein:

the distal plate includes voids;

the coupler includes a long axis that intersects the proximal and distal plates; and a plane, which is orthogonal to the long axis, intersects the voids.

8. The system of claim 2, wherein:

the coupler includes a long axis that intersects the proximal and distal plates;

the first electrical contact has a maximum breadth measured orthogonal to the long axis;

the first bulkhead has distal-most end and the distal-most end has a maximum breadth measured orthogonal to the long axis; and the maximum breath of the first electrical contact is greater than the maximum breadth of the distal-most end of the first bulkhead.

9. The system of claim 8, wherein the first bulkhead tapers and narrows proximally such that a proximal end of the first bulkhead has a smaller maximum breadth, measured orthogonal to the long axis, than the maximum breadth of the distal-most end of the first bulkhead.

10. The system of claim 1, wherein the electrical switch is between the first and third bulkheads.

11. The system of claim 1 comprising a mold, wherein:

the first bulkhead includes a monolithic metal conductor that extends from a proximal most end of the first bulkhead to a distal-most end of the first bulkhead electric contact;

the monolithic metal conductor includes no welds, seems, or resilient members;

the mold includes a non-metal material; and the mold directly contacts and is form-fitted to a monolithic metal conductor.

12. The system of claim 1, wherein:

the coupler includes a long axis that intersects the proximal and distal plates;

the long axis intersects the first and third bulkheads but not the second bulkhead;

a plane, which is orthogonal to the long axis, intersects the first and second bulkheads but not the third bulkhead.

13. The system of claim 1, wherein the coupler is configured to couple the perforation gun to the additional perforation gun and to reduce a transmission of explosive induced pressure between the perforation gun and the additional perforation gun.

14. A hydraulic fracturing system comprising:

a perforation gun that includes a first outer conduit, a first inner conduit included in the first outer conduit, a first proximal connector, and a first distal connector;

a tandem sub included in the perforation gun;

first, second, and third insulated conductors included in the tandem sub;

an electrical switch included in the tandem sub, wherein the electrical switch includes a printed circuit board (PCB);

wherein the first proximal connector includes: (a) a first proximal electrical contact to couple to an additional first insulated conductor of an additional tandem sub, (b) a second proximal electrical contact to couple to an additional second insulated conductor of the additional tandem sub; and (c) an aperture to receive a detonator;

wherein the first distal connector includes a distal electric contact to couple to the third insulated conductor;

wherein the first, second, and third insulated conductors respectively include first, second, and third insulated conductor electric contacts, and the first, second, and third insulated conductor electric contacts include no resilient members, wherein: (a) the first insulated conductor is to couple to an additional first proximal electrical contact of an additional proximal connector of an additional perforation gun, (b) the second insulated conductor is to couple to an additional second proximal electrical contact of the additional proximal connector of the additional perforation gun.

15. The system of claim 14, wherein:

the tandem sub includes proximal and distal plates;

the distal plate has first and second electrical contacts;

the proximal plate has a third electrical contact;

the first insulated conductor couples the first electrical contact to the electrical switch;

the second insulated conductor couples the second electrical contact to the electric switch;

the third insulated conductor couples the third electrical contact to the electric switch; and the second electrical contact encircles the first electrical contact.

16. The system of claim 15, wherein:

the proximal and distal plates are removably coupled to the tandem sub;

the proximal plate is not screwed to the tandem sub;

the proximal plate is not adhered to the tandem sub with an adhesive;

the distal plate is not screwed to the tandem sub; and the distal plate is not adhered to the tandem sub with an adhesive.

* * * * *